US010845027B2

(12) United States Patent
Hinrichs et al.

(10) Patent No.: US 10,845,027 B2
(45) Date of Patent: Nov. 24, 2020

(54) SPARKLE EFFECT LIGHTING DEVICE

(71) Applicant: ELATION LIGHTING, INC., Los Angeles, CA (US)

(72) Inventors: Matthias Hinrichs, Prior Lake, MN (US); Toby Velazquez, Yorba Linda, CA (US)

(73) Assignee: ELATION LIGHTING, INC., Los Angeles, CA (US)

( * ) Notice: Subject to any disclaimer, the term of this patent is extended or adjusted under 35 U.S.C. 154(b) by 0 days.

(21) Appl. No.: 16/820,418

(22) Filed: Mar. 16, 2020

(65) Prior Publication Data

US 2020/0217481 A1 Jul. 9, 2020

Related U.S. Application Data

(63) Continuation of application No. 16/272,841, filed on Feb. 11, 2019, now Pat. No. 10,670,225.

(60) Provisional application No. 62/730,724, filed on Sep. 13, 2018.

(51) Int. Cl.

| | |
|---|---|
| ***F21V 5/00*** | (2018.01) |
| ***H05B 47/155*** | (2020.01) |
| *F21Y 115/10* | (2016.01) |
| *F21W 131/406* | (2006.01) |
| *F21W 121/00* | (2006.01) |

(52) U.S. Cl.

CPC ..... *F21V 5/007* (2013.01); *H05B 47/155* (2020.01); *F21W 2121/00* (2013.01); *F21W 2131/406* (2013.01); *F21Y 2115/10* (2016.08)

(58) Field of Classification Search

CPC ..... F21V 5/007; H05B 47/155

See application file for complete search history.

(56) References Cited

U.S. PATENT DOCUMENTS

| | | | | |
|---|---|---|---|---|
| 4,963,798 | A * | 10/1990 | McDermott | F21L 4/027 315/312 |
| 4,967,291 | A * | 10/1990 | Touchton | G11B 5/5547 360/75 |
| 8,858,037 | B2 | 10/2014 | Li | |
| 10,132,992 | B2 | 11/2018 | Jurik et al. | |

OTHER PUBLICATIONS

U.S. Non-Final Office Action for U.S. Appl. No. 16/272,841 dated Aug. 15, 2019.

U.S. Final Office Action for U.S. Appl. No. 16/272,841 dated Dec. 26, 2019.

U.S. Notice of Allowance for U.S. Appl. No. 16/272,841 dated Mar. 11, 2020.

* cited by examiner

*Primary Examiner* — Thomas M Sember

(74) *Attorney, Agent, or Firm* — Sherman IP LLP; Kenneth L. Sherman; Hemavathy Perumal

(57) ABSTRACT

A lighting device includes a lens, a primary light source and multiple secondary light sources positioned about a perimeter of the lens. Each of the secondary light sources is configured to produce a sparkling effect.

9 Claims, 6 Drawing Sheets

100
106
104
102

106
110
104
102

106
104
102

SPARKLE EFFECT LIGHTING DEVICE

CROSS-REFERENCE TO RELATED APPLICATION

The present application is a continuation of and claims priority to U.S. patent application Ser. No. 16/272,841, filed on Feb. 11, 2019, which in turn claims priority to U.S. Provisional Patent Application Ser. No. 62/730,724 filed on Sep. 13, 2018, all incorporated herein by reference.

BACKGROUND

Light emitting diode (LED) lighting systems provide illumination and direct view effects. Some conventional stage lighting use LEDs as a light source. LED lighting typically have high light output with low power consumption.

SUMMARY

Embodiments relate to lighting devices, in particular, lighting devices including a lens, a primary light source and multiple secondary light sources positioned about a perimeter of the lens. Each of the secondary light sources is configured to produce a sparkling effect.

These and other aspects and advantages of one or more embodiments will become apparent from the following detailed description, which, when taken in conjunction with the drawings, illustrate by way of example the principles of the one or more embodiments.

BRIEF DESCRIPTION OF THE DRAWINGS

For a fuller understanding of the nature and advantages of the embodiments, as well as a preferred mode of use, reference should be made to the following detailed description read in conjunction with the accompanying drawings, in which.

DETAILED DESCRIPTION

The descriptions of the various embodiments have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

Figures 1A, 1B, 1C:
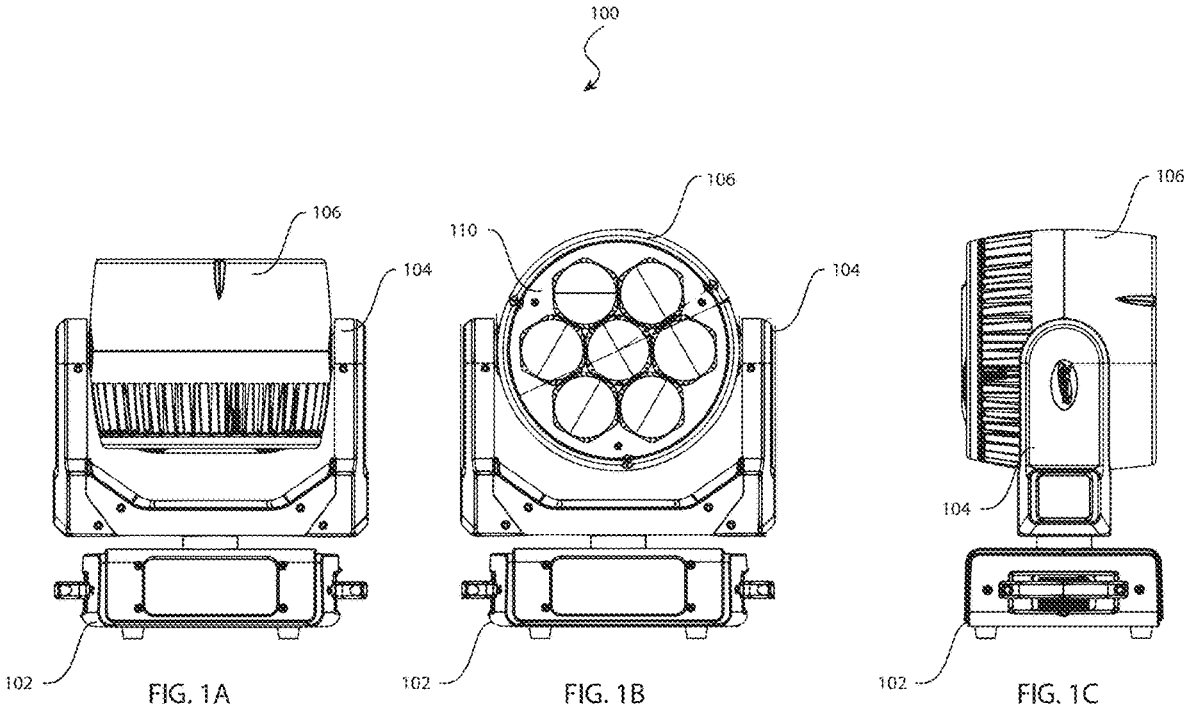
FIG. 1A is a profile view of a lighting device oriented so the face of the device is pointing in an upwards direction, according to some embodiments.
FIG. 1B is a head-on view of a lighting device, according to some embodiments.
FIG. 1C is a profile view of a lighting device oriented so the lens array of the device is pointing in a lateral direction, according to some embodiments.

FIG. 1A is a profile view of a lighting device 100 oriented so the face of the device is pointing in an upwards direction, according to one embodiment. In some embodiments, the lighting device 100 comprises a base 102, a yoke 104 and housing 106. In this orientation, the lens array (110, FIG. 1B) is pointed in an upwards position so a resulting output beam from the primary lighting sources and multiple secondary lighting sources would point upwards. In one or more embodiments, the lighting device 100 includes a controller, electronics, one or more motors, a power switch, one or more lighting switches, and an electrical plug or receptacle, etc. for connecting to provide power to operate the lighting device 100, as known to those of ordinary skill in the art. Further, any conventional components required to operate the lighting device, such as wiring, circuitry, power sources (e.g., AC, DC, battery, USB, etc.) may be employed by one or more embodiments.

FIG. 1B is a head-on view of a lighting device 100, according to an embodiment. In this orientation, the lens array 110 is visible. FIG. 1C is a profile view of a lighting device 100 oriented so the lens array is pointing in a lateral direction, according to an embodiment.

Figure 2:
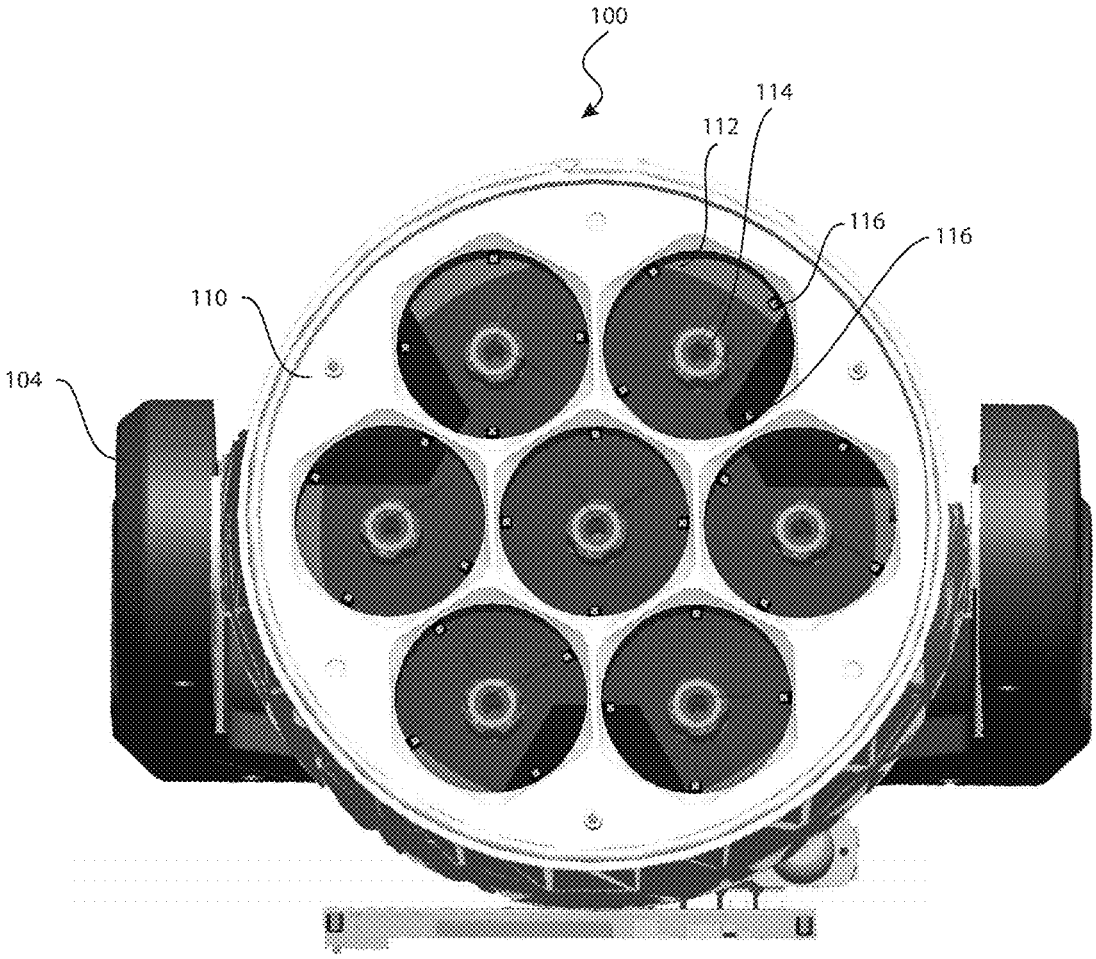
FIG. 2 is a close-up view of the lens array of the lighting device, according to some embodiments.

FIG. 2 is a close-up view of the lens array 110 of the lighting device 100, according to an embodiment. Each respective lens in the lens array 110 comprises: a lens 112, a primary light source 114 and multiple secondary light sources 116. In some embodiments, the primary light source 114 is a multi-color light emitting diode (LED), but it is understood that any component capable of emitting light can be construed as a primary light source (e.g., incandescent lamp, high-intensity discharge lamp, video, neon, chip on board (COB), etc.). The primary light source 114 resides primarily in the center of and behind the lens 112. About the perimeter of the lens 112 resides multiple secondary light sources 116. In some embodiments, there are four secondary light sources 116 along the perimeter of the lens 112. It is understood that any number of secondary light sources 116 may be used in connection with a lens 112 and primary light source 114. In some embodiments, each of the secondary light sources 116 is a single color LED. However, it is understood that secondary light sources 116 can be of any variety of color, multi-color, etc., light emitting component.

In one or more embodiments, the secondary light sources 116 are also equidistant from each other as they circumscribe the lens 112. The secondary light sources 116 are each capable of producing a sparkle effect. The sparkle effect is understood to be a change in brightness (e.g., ramping up/down, dimming) or a switching on/off and changing the frequency of the switching or both including the separate control of red, green, blue, white and/or amber LEDs to create effects that include fading or flashing.

Figure 3:
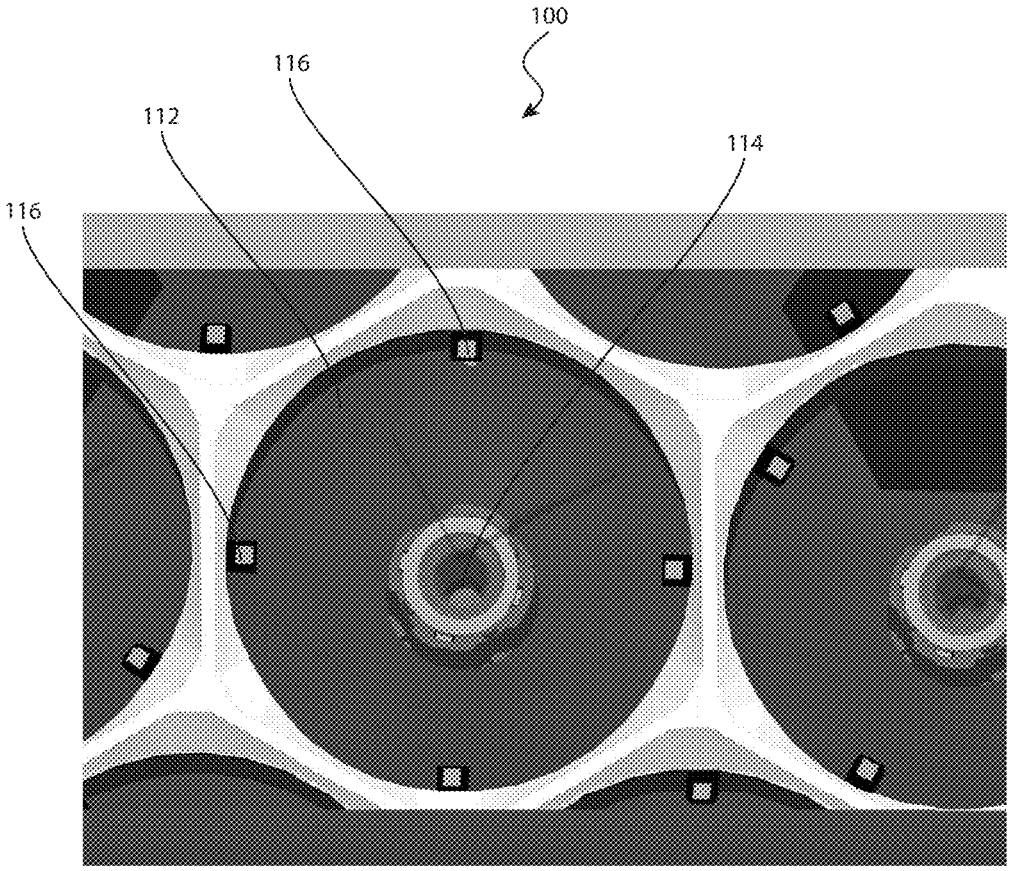
FIG. 3 is an alternative close-up view of the lens array including the lens, primary light source and plurality of secondary light sources, according to some embodiments.

In some embodiments, the secondary light sources 116 reside behind the lens 112 such that the output of the secondary light sources 116 enter the lens 112 on an input surface and exit the lens on the output surface, same as with the primary light source 114. FIG. 3 is an alternative close-up view of the lens array including the lens 112, primary light source 114 and multiple secondary light sources 116, according to an embodiment.

In some embodiments, a light guide resides in front of a multicolor primary light source 114. In some embodiments, the light guide is a light pipe type guide where the light exiting the primary light source enters the light pipe is refracted against the internal surfaces of the light pipe and then exits the light pipe towards an aperture. After the aperture, the light is focused using the lens 112. In one or more embodiments, the lens 112 is capable of moving closer or farther from the aperture, the result of which is a wide angle or narrow angle output beam. In some embodiments, at least one secondary light source 116 is placed on input surface of the lens 112 along the edge thereof or any other desired place within the lens 112. Placement of the secondary light source 116 creates a second layer of light output which can overlay, merge or appear separate from the primary light source 114 depending on relative position of the secondary light source inside the lens 112, the lens 112 type and/or the relative intensities of primary and secondary light sources.

In some embodiments, the arrangement and patterns of the secondary light sources 116 can be of any variation, the desired effect is not dependent on the layout shown in FIGS. 2-4. Variations in the secondary light source 116 orientation are possible depending on what visual appearance is desired. For example, placement of the secondary light sources 116 under the lens 112 leads to refractions and lighting emissions that help illuminate the lens 112 from the inside, providing visually interesting results.

In one or more embodiments, the secondary light sources 116 transverse to center of the lens 112 such that the light output of the secondary light sources 116 shines into the edge of the primary light source 114. In some embodiments, the secondary light sources 116 are movable by mechanical means, and that their angle in relation to the lens 112 are variable for additional changes in resulting light output and refraction.

FIG. 3 more clearly demonstrates the position of the secondary light sources 116 in relation to the perimeter of the lens 112 and the primary light source 114, according to some embodiments. The secondary light sources 116 are positioned such that each causes the least amount of interference with the light emitted from the primary light source 114.

In one or more embodiments, the secondary light sources 116 reside on the input surface of the lens 112. In some embodiments, the secondary light sources 116 reside on the output surface of the lens 112. In one or more embodiments, the secondary light sources 116 reside within the lens 112, between the input and output surfaces. In some embodiments, the secondary light sources 116 reside in a plane parallel with the output surface of the lens 112.

Figure 4A:
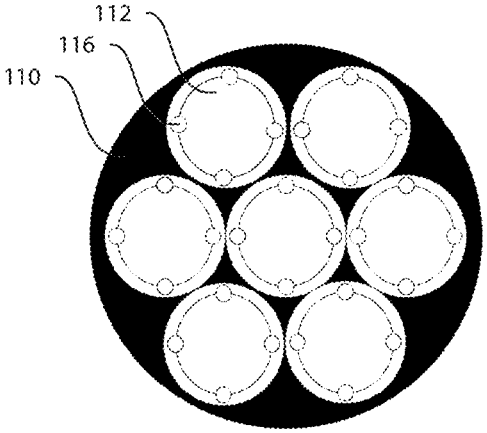
FIG. 4A is an orientation of the secondary lighting sources, according to some embodiments.

FIG. 4A is an orientation of the secondary lighting sources 116, according to some embodiments. In this orientation, the lens array 110 comprises seven individual lenses 112, each having four secondary light sources 116 each, located about the perimeter of the lens 112 (the primary light sources 114 are not shown for simplicity of the figure). In this orientation, the secondary light sources 116 are oriented in a north/south and east/west configuration along the lens array 110. In some embodiments, each of the secondary light sources 116 are a single color LED (e.g., white, red, green, blue, amber LEDs), multi-colored (e.g., rgb, rgbw, rgbwa) LEDs, or a mix thereof. In one or more embodiments, the secondary light sources 116 are controllable independently from the primary light sources (114, FIG. 3) and each secondary light source 116 is configured to be independently controllable from other secondary light sources. In one or more embodiments, the primary light source 114 and secondary light sources 116 are controllable via a variety of lighting and video control protocols (e.g., dmx512, RDM, wifi, video, artnet, etc.) Thus, the sparkling effect produced by the secondary light sources 116 are uniform across the lens array 110 or can move about and/or meander across the face of the lens array 110 to give the appearance that the lens array comprises a series of facets.

Figure 4B:
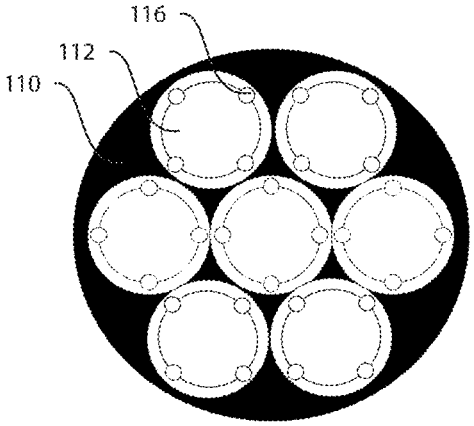
FIG. 4B is an alternative orientation of the secondary lighting sources, according to some embodiments.

FIG. 4B is an alternative orientation of the secondary lighting sources 116, according to some embodiments. In this orientation, a number of sets of the secondary light sources 116 are oriented in a north/south and east/west configuration while the remaining sets of secondary light sources 116 are rotated clockwise/counterclockwise to positions between the north/south and east/west configuration. This is evident in the two top most and bottom most clusters of secondary light sources 116, which are rotated relative to the position of the north/south and east/west secondary light sources 116 towards the middle of the lens array 110. While one or more embodiments demonstrate uniform disbursement of the secondary light sources 116 along the perimeter of a lens 112, it can be appreciated that other embodiments include non-uniform spacing of the secondary light sources 116 as desired.

Figure 4C:
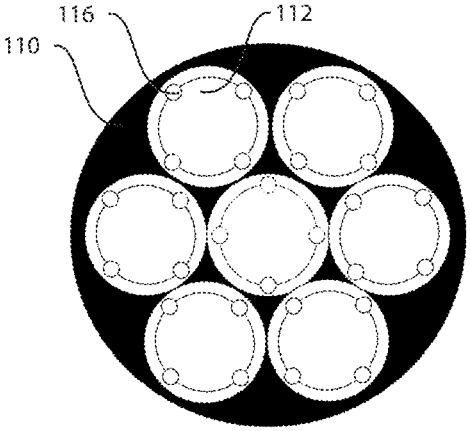
FIG. 4C is an alternative orientation of the secondary lighting sources, according to some embodiments.

FIG. 4C is an alternative orientation of the secondary lighting sources 116, according to some embodiments. In one or more embodiments, the secondary light sources 116 circling the center lens 112 in the lens array 110 are oriented in a north/south and east/west configuration while the six other lenses 112 and multiple secondary light sources 116 are rotated relative to the orientation of the center most secondary light sources 116.

Figure 5:
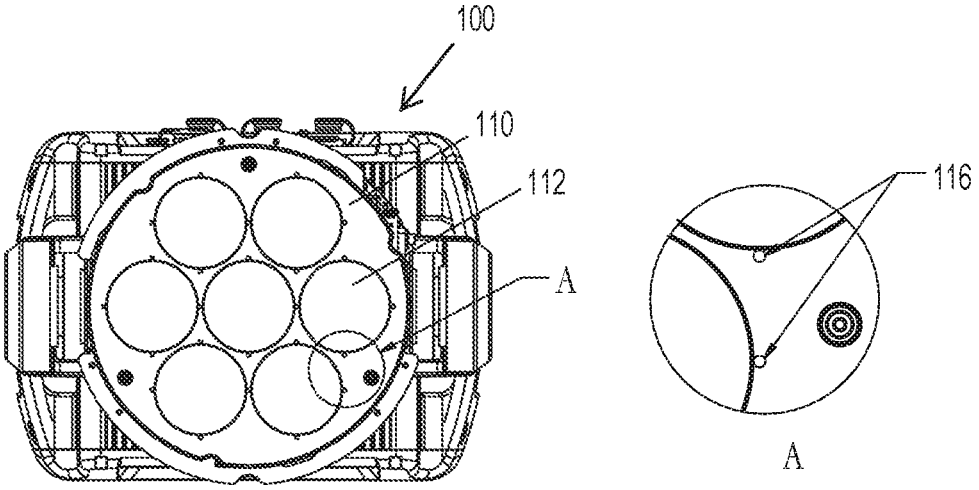
FIG. 5 is another alternative close-up view of the lens array including the lenses and the secondary light sources, according to some embodiments.

FIG. 5 is another alternative close-up view of the lens array 110 including the lenses 112 and the secondary light sources 116, according to some embodiments. An expanded view A of a section of the lens array 110 shows the secondary light sources 116 disposed in front of the lenses 112.

Figure 6:
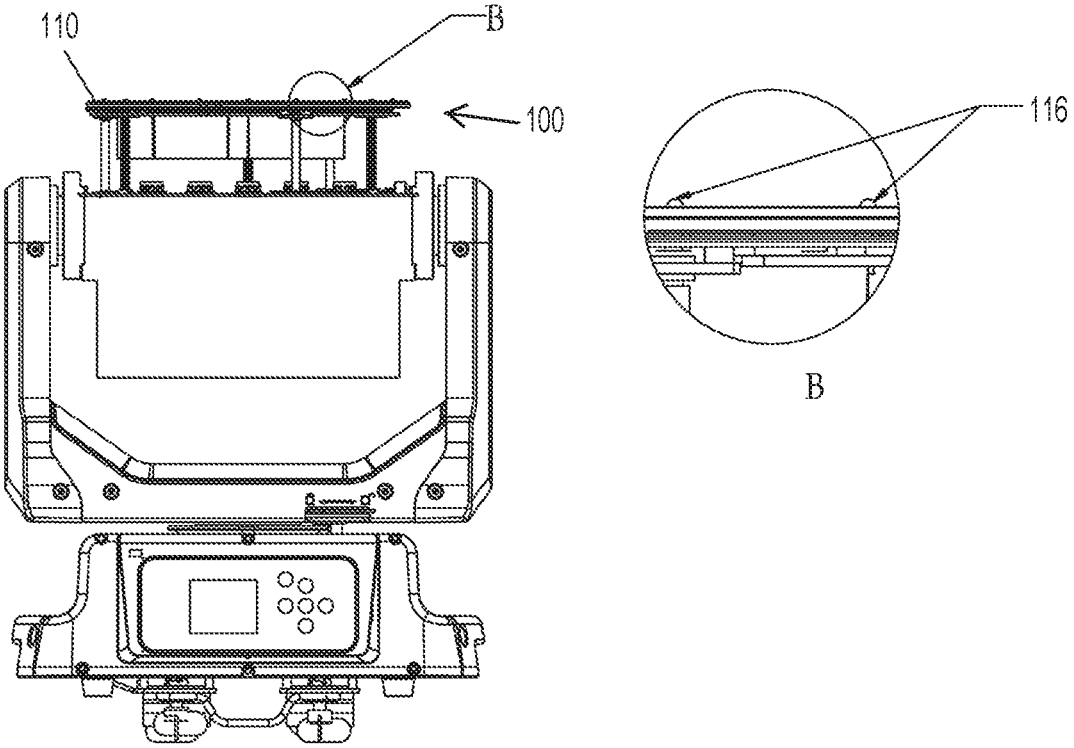
FIG. 6 is an alternative profile view of the lighting device including the lens array oriented so the face of the device is pointing in an upwards direction, according to some embodiments.

FIG. 6 is an alternative profile view of the lighting device 100 including the lens array 110 oriented so the face of the device 100 is pointing in an upwards direction, according to some embodiments. An expanded view B of a section of the lens array 110 shows the secondary light sources 116 disposed in front of the lenses 112.

Figure 7:
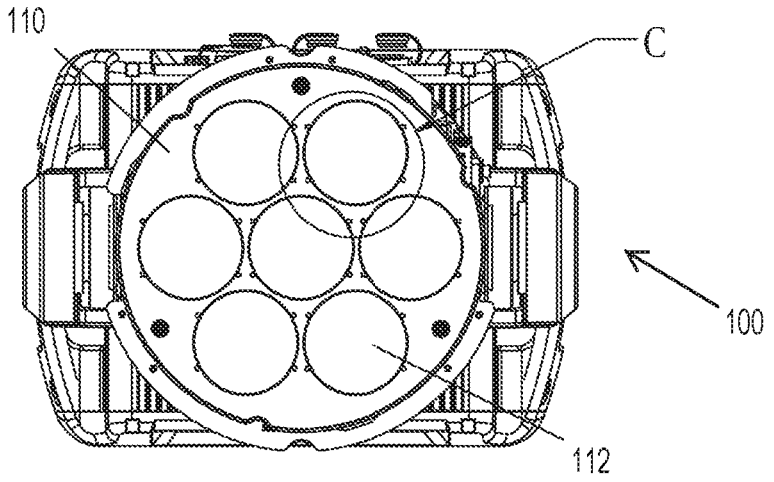
FIG. 7 is yet another alternative close-up view of the lens array including the lenses and the secondary light sources, according to some embodiments.
Figure 7:
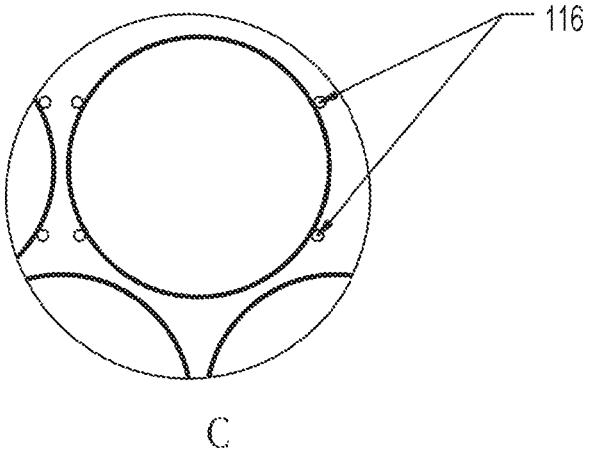

FIG. 7 is yet another alternative close-up view of the lens array 110 including the lenses 112 and the secondary light sources 116, according to some embodiments. An expanded view C of a section of the lens array 110 shows secondary light sources 116 non-uniformly spaced along a perimeter of a lens 112.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, materials, and/or components, but do not preclude the presence or addition of one or more other features, steps, operations, elements, materials, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A lighting device, comprising:

a lens array comprising a plurality of lenses; and for each lens of the lens array:

a corresponding primary light source centrally disposed behind the lens; and a corresponding plurality of secondary light sources disposed in front of the lens, wherein the corresponding plurality of secondary light sources are configured to produce a sparkling effect.

2. The lighting device of claim 1, wherein the corresponding plurality of secondary light sources are positioned about a perimeter of the lens.

3. The lighting device of claim 1, wherein the corresponding plurality of secondary light sources are uniformly spaced along the perimeter of the lens.

4. The lighting device of claim 1, wherein the corresponding plurality of secondary light sources are non-uniformly spaced along the perimeter of the lens.

5. The lighting device of claim 1, wherein the corresponding plurality of secondary light sources are independently controllable from the corresponding primary light source.

6. The lighting device of claim 1, wherein each secondary light source of the corresponding plurality of secondary light sources is independently controllable from another secondary light source of the corresponding secondary light sources.

7. The lighting device of claim 1, wherein the corresponding plurality of secondary light sources are oriented in a north-south and east-west configuration along the lens array.

8. The lighting device of claim 1, wherein:

for a first lens of the lens array, a first plurality of secondary light sources corresponding to the first lens are oriented in a north-south and east-west configuration along the lens array; and for a second lens of the lens array, a second plurality of secondary light sources corresponding to the second lens are oriented in positions between the north-south and east-west configuration along the lens array.

9. The lighting device of claim 1, wherein the sparkling effect produced by the corresponding plurality of secondary light sources is uniform across the lens array.

* * * * *